US005898938A

United States Patent [19]

Baylor et al.

[11] Patent Number: 5,898,938

[45] Date of Patent: May 4, 1999

[54] HAND PROTECTING DEVICE

[76] Inventors: Don Edward Baylor, Denver; David Richard Cilladi, Arvada; Marilyn Michele Killeen-Cornelison, Denver, all of Colo.

[21] Appl. No.: 08/866,781

[22] Filed: May 30, 1997

Related U.S. Application Data

[63] Continuation of application No. 08/514,188, Aug. 11, 1995, abandoned, which is a continuation-in-part of application No. 08/504,948, Jul. 20, 1995, abandoned.

[51] Int. Cl.[6] ..... A41D 13/10

[52] U.S. Cl. ..... 2/20; 2/161.1

[58] Field of Search ..... 2/16, 19, 20, 18, 2/161.1, 158, 159, 160

[56] References Cited

U.S. PATENT DOCUMENTS

| | | | |
|---|---|---|---|
| 3,882,548 | 5/1975 | Shinagawa et al. | 2/16 |
| 4,042,975 | 8/1977 | Eliott, Jr. et al. | 2/19 |
| 4,570,269 | 2/1986 | Berlese | 2/20 |
| 5,640,712 | 6/1997 | Hansen et al. | 2/20 |

*Primary Examiner*—Michael A. Neas
*Attorney, Agent, or Firm*—Dykema Gossett PLLC

[57] ABSTRACT

The hands of a baseball batter which are exposed to the greatest risk of injury from impact by a baseball are protected by specially configured gloves. The gloves are retained in position by selective finger hole placement in a stretchable sleeve. A shock absorbing material in a pad overlies the areas of greatest injury risk. The material absorbs and distributes energy from the blow of the baseball thereby avoiding or at least significantly minimizing the prospect of serious injury to the bones and tissue of the hand caused by striking thereof by a baseball or the like.

1 Claim, 11 Drawing Sheets

HAND PROTECTING DEVICE

This is a continuation of application Ser. No. 08/514,188, filed Aug. 11, 1995, which is now abandoned, which is a continuation-in-part of application Ser. No. 08/504,948, filed Jul. 20, 1995, which is now abandoned.

BACKGROUND OF THE INVENTION

1. Field of the Invention

This invention relates to devices and methods for protecting the hand against injury from an impact. More particularly, this invention relates to new and improved glove type or structures and processes especially useful to protect the bones of the hand, including the metacarpal bones and knuckles, as well as the tissues in a hand of the user, from injury caused by a traumatic blow. The present invention is especially useful for baseball players while participating as batters in a baseball game.

2. Description of the Related Art

In many sports, the hands of participating players are highly subject to injury during play. A hand injury not only can cause severe pain, discomfort and disruption in the personal life of the player, but also can sideline that player for an entire season, hampering development and performance for that player in the sport. Such injuries impact team performance, as well by denying the services of the player to the team. For the amateur player, a hard injury impedes playing time and thus skill development at all ages. In professional sports, hand injuries can have a dramatic effect, such as a negative economic impact on the injured player, as well as on the team of that player. The team must pay for a player to replace the injured party all the while that they may have a responsibility to continue paying the player whose services are denied to the team while disabled. If the player is exceptionally skilled in the sport, a forced injury absence of the player may affect the overall team performance which in turn could well affect game attendance, playoff chances, fan support, and the financial reward for all.

Specifically, the hands of a baseball player are highly subject to injury while batting. The baseball batter must attempt to hit the ball with a bat as it moves at least partially through an area over home plate called the strike zone where the ball is supposedly hittable by the batter. Historically, baseball pitchers have developed pitches intended to fool the batter into thinking the ball will not enter the strike zone, but which actually curve or "move" into the strike zone at the last moment. Thus, in order to hit a pitched ball, the player must watch the ball from its release by the pitcher until it crosses the plate.

With the refinement of sophisticated pitching techniques and greater athletic skill, present pitchers are throwing balls faster (upwards of 100 miles per hour), and with more movement (such as the so-called curveball, slider, sinker, palmball, knuckle, etc.,—some moving 12 inches or more), thus requiring the player to watch the ball very closely after release by the pitcher in order to determine if the ball is worth attempting to hit.

Hands are exposed to injury during batting typically because the batter is watching in an effort to decide whether or not the ball will move into the strike zone. When the pitcher throws the ball high and inside with respect to the strike zone (meaning towards the hitters head/neck), oftentimes the ball is a curveball or other "moving" pitch and may break across the plate into the strike zone. In this case, the batter needs to watch the ball to insure it is going to curve, and thus is worthy of an attempt to hit it.

Unfortunately, pitchers sometimes release a fastball, which does not curve or move laterally as it approaches the plate, but which is moving towards the batter instead of the strike zone. There is little time for the batter to conclude it is necessary to take evasive action to avoid being hit by the ball. Furthermore, batters are trained to prepare for balls that curve or move by watching the ball all the way across the plate. This further reduces the time in which the batter can decide to take evasive action and move away from the ball. As a result, the chances increase that a pitch which is high and inside relative to the strike zone and which does not break away from the batter very well may strike the batter.

The potential injuries sustained by a hand when struck by a pitched ball that is high and inside relative to the strike zone include soft tissue damage as well as bone damage. The metacarpal bones along the back of the hand, especially the metacarpal bones connected to the little finger and the ring finger, are especially vulnerable to injury from impact by a pitched ball. As mentioned above, if even one of the metacarpal bones are broken, the player is unable to play for several weeks, if not months, resulting in the aforementioned adverse physical, mental and monetary effects.

While batting, most players use batting gloves on either or both hands. Batting gloves are light, close-fitting gloves which improve the batter's grip on the bat, and also protect against hot-spots and abrasions. Batting gloves are considered as personal items. Players are often sensitive and even temperamental about the batting gloves they use. For instance, batting gloves are sometimes considered good and bad-luck charms. Players are also often sensitive to their habits while batting, and will not accept additional weight or bulk which might adversely affect their bat speed. Also, batting gloves are basically considered consumable, and are sometimes used once and thrown away by the player. Sometimes the player also wears the same batting glove while on defense to help make the fielding glove fit more securely.

The contemporary systems developed for dealing with the potential hand injuries while batting have not resolved the problem. Some attempts include building rigid protection into the batting glove, the rigid protection covering both the back of the player's hand and part of the player's wrist. Other attempts have included rigid protection built into the batting glove over only the back of the hand. These attempts at reducing and preventing hand injuries have not proven successful for many reasons. One major reason is that the gloves are too structurally bulky for the player, potentially altering the player's swing, and thus making the player choose to risk injury. Other reasons include that the player cannot use the same glove in conjunction with his fielding glove when playing defensively, that the gloves are too expensive to be simply thrown away if the player decides it is bad-luck, etc.

As is apparent from the subsequent description, the aforementioned deficiencies in the prior art are overcome by the present invention.

SUMMARY OF THE INVENTION

Apparatus in accordance with this invention is intended to protect a hand in at least part of the area between the wrist and the knuckle joints against injury from a traumatic impact. The present invention is intended to provide maximum protection for the hand of a baseball batter while causing minimal interference with movement of that hand as is associated with swinging a bat at a baseball.

In one implementation of this invention, flexible elastic fabric, such as Spandex, is formed into a sleeve with an opening for permitting entry of a hand into its interior. A layer of force-absorbing material is attached permanently or in removable relation with respect to an external surface of that sleeve. The sleeve includes an arrangement for retaining the layer in overlying relation to at least a portion of one metacarpal bone of the hand when that hand is inserted into the interior of the sleeve.

The layer retaining arrangement can include first and second openings for respectively receiving the thumb and at least one finger of the hand inserted into the sleeve. By this, the sleeve is held in a generally fixed relation, as between the thumb and finger, for preventing movement of the shock absorbing layer from its bone overlying relationship. It is also possible to construct and arrange the layer in an overlapping arrangement for concurrently overlying at least a portion of the back and outer edge of the metacarpal bone of the little finger of the hand inserted into the sleeve.

In one embodiment, the shock absorbing and distributing layer is constructed and arranged for overlying at least a portion of the metacarpal bones of both the little finger and the ring finger of the hand inserted into the sleeve. In yet another embodiment, the impact absorbing layer is constructed and arranged for overlying at least a portion of the metacarpal bones of all of the fingers of the hand inserted into the sleeve. The sleeve can fit underneath or over a conventional batting glove, if desired. It can take on the configuration of a full glove with a plurality of compartments for receiving the fingers and thumb of the hand after the hand is inserted into the sleeve. Further, it can resemble a conventional glove except modified to include an arrangement for securing a protective pad type element such as via a receiving pocket or a Velcro type of attachment.

An attractive material for one form of the force-absorbing layer is silicone gel sheet material. It is relatively light weight, but has characteristics especially suitable for the protective layer. One way of attaching this layer to the sleeve is to employ a panel of flexible material secured to the external surface of the sleeve for forming a pocket to receive at least one sheet of said silicone gel sheet material. In one model, a silicone gel sheet material which overlies the metacarpal bone with a thickness of approximately ten millimeters was found adequate.

More particularly, this invention is a device for protecting at least a portion of the bones and tissues between the wrist and knuckle joints of the hand of a baseball batter so as to prevent or minimize injury caused by impact of that portion of the hand by a thrown baseball. The sleeve of stretchable material has an opening for receiving a hand and including at least two ports for receiving the thumb and at least one finger after the hand is inserted into the sleeve opening. The layer of force absorbing and distributing material is secured by a panel of stretchable material to the outer surface of the sleeve.

This panel forms a pocket for receiving the protective layer, and for retaining it in overlying relation to the metacarpal bone of the little finger of the hand after insertion of that hand into the sleeve opening followed by insertion of the thumb and finger in respective ports. If desired, the protective layer can extend around a portion of the metacarpal bone of the little finger of the hand for protecting that bone on the back of the hand, as well as on the side edge of the hand.

It is believed some baseball players will consider it preferable to use a device wherein the layer overlies at least a portion of the metacarpal bones of the little finger and ring finger of the hand inserted into the sleeve. Once again, the sleeve can fit within or over an existing batting glove, or it is possible to configure the sleeve as a complete glove with separate compartments for encasing each finger and the thumb.

Other baseball players may prefer a layer which overlies some, or all, of the metacarpal bones of all of the fingers of the hand inserted into the sleeve with, or without, an extension of the protective layer around a portion of the metacarpal bone of the little finger of the hand for protecting that bone on the back and side edge of the hand.

The invention includes the method of protecting the metacarpal bones of a player in a baseball game from injury when impacted by a thrown baseball. The first step is to form a layer of force-absorbing material. This layer is placed in overlying relation to the metacarpal bone of at least the little finger of the hand of the player which is closest to the source of the thrown baseball. The layer is thereafter retained in the overlying relation while the thus protected hand of the player is moved in motions associated with participation in the baseball game.

The method can further include the step of extending the force-absorbing layer over the metacarpal bone of the little finger of the hand throughout at least a substantial portion of both the back area of the hand and the outer edge of that hand, over the metacarpal bones of the little finger and ring finger of the hand, and/or over at least a portion of all of the metacarpal bones of the hand.

Another form of the device and process in accordance with this invention protects a hand in at least part of the area between the wrist and the knuckle joints against injury from a traumatic impact while that hand is wearing a contemporary glove structure. A layer of force absorbing material is attached to an external surface of the glove structure, and includes an arrangement for retaining that layer in overlying relation to at least a portion of one metacarpal bone of the hand.

A sleeve of flexible material having an opening for permitting entry of a hand into the interior of that sleeve can have openings for insertion of fingers of the user while wearing the contemporary glove. This sleeve can have an opening arranged for overlying the palm of the glove wearer when the sleeve is in place. The attachment can be effected by a pocket secured to the external surface of the glove, or by mating Velcro surfaces on the protective layer and the external surface of the glove.

The protective layer can include a relatively firm shell and a pad of force absorbing gel. The shell and pad can have Velcro fastener material thereon for permitting attachment to one another, as well as for selective attachment of either element to the external surface of the glove. The arrangement for attaching the protective layer to the glove can include a panel of flexible material secured to the external surface of the glove for forming a pocket to receive at least one sheet of silicone gel sheet material. This layer can extend around a portion of the metacarpal bone of the little finger of the hand for protecting the bones on the back and side edge of the hand.

Those having normal skill in the art will recognize the foregoing and other objects, features, advantages and applications of the present invention from the following more detailed description of the preferred embodiments as illustrated in the accompanying drawings.

DETAILED DESCRIPTION OF THE PREFERRED EMBODIMENTS

Figure 1:
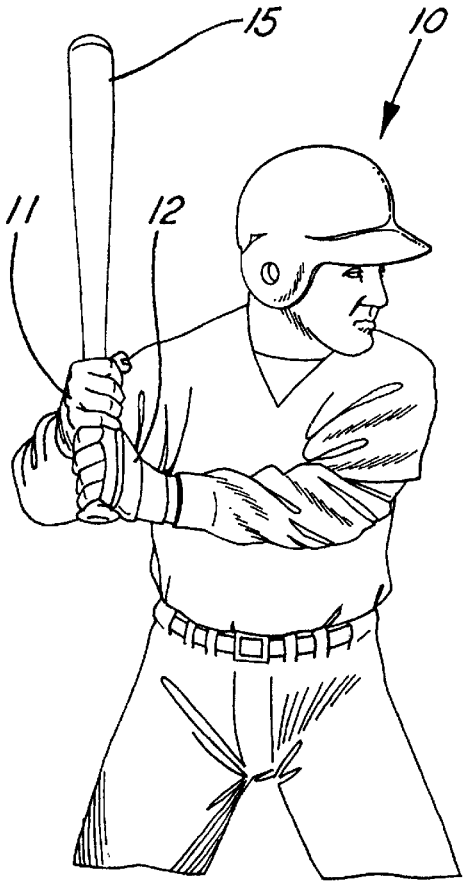
FIG. 1 illustrates the stance of a typical baseball batter as a pitch is awaited.

FIG. 1 presents a typical position assumed by a batter 10 who is participating in a baseball game and awaiting the arrival of a baseball thrown by a pitcher. The batter 10 is standing next to homeplate (not shown) looking towards the pitcher (also not shown) with his or her hands 11 and 12 gripping bat 15 (note FIG. 3) The strike zone mentioned earlier herein is over homeplate in front of the batter 10. While the strike zone has changed in size somewhat over the years and even now is subject to some difference of opinion as to its actual location, particularly during the course of hotly-contested baseball games, it is generally considered to encompass the width of homeplate and the distance between the knees and midriff of batter 10

A batter hitting right handed is shown in this application, and the devices described are oriented to right handed batters. However, the invention is clearly adaptable to left handed batters who would use the protective device on their right hand 11. A batter 10 could use a device in accordance with this invention on both hands, if desired, but it is expected that the preferred use is likely to center on the hand closest to the pitcher, and thus technically at greater risk of injury from a pitch.

Figure 2:
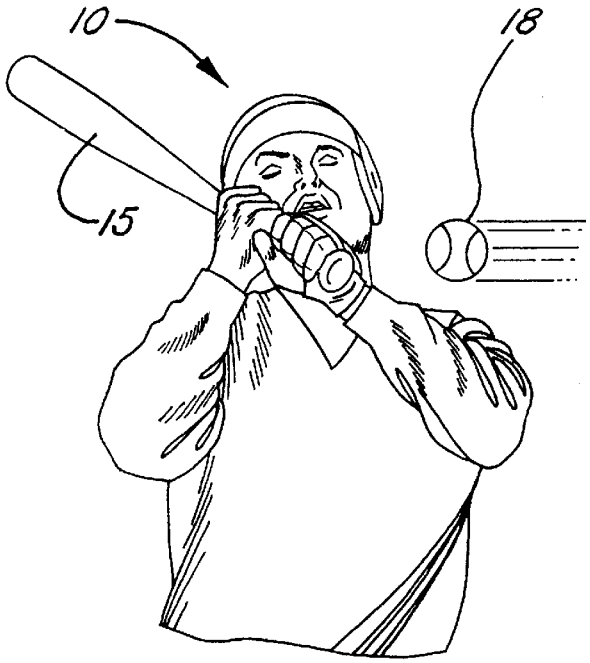
FIG. 2 shows the relation between the batter and an approaching baseball as the batter attempts to avoid the ball.

The batter's hands 11 and 12, because of their position in the batting stance, are exposed toward the pitcher, and are subject to impact by a high pitch out of the strike zone towards batter 10. Even when the batter leans back in an attempt to avoid ball 18 approaching from such a high and inside pitch, as shown in FIG. 2, the hands are sometimes moved upwardly, and become ever more exposed to striking by ball 18. At other times the hand towards the pitcher might assume a flat orientation in a plane generally transverse to the line of flight of the ball. Given the fact that the ball is thrown at very high speeds, the batter perhaps has approximately one-half of a second to watch the ball and make a decision on whether to swing at it or to attempt to avoid being hit by an errant pitch.

Figure 3:
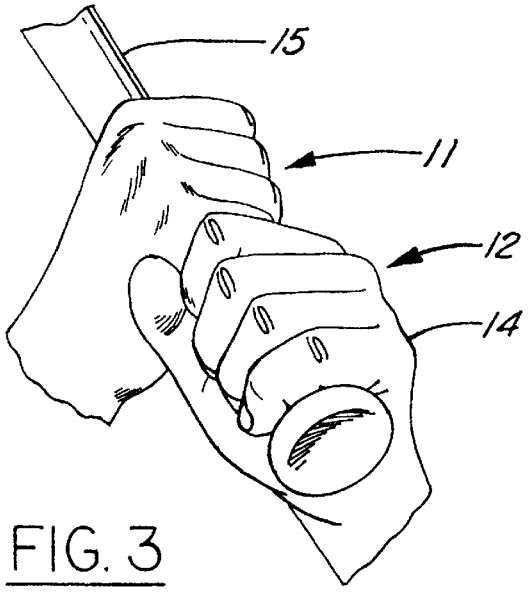
FIG. 3 shows the exposure of the fingers of a batter who is holding a bat with respect to an approaching baseball.

While both hands 11 and 12 are at risk, FIGS. 1, 2 and 3 illustrate that the back of the right handed player's left hand 12 is particularly exposed to the pitched ball 18, and is more likely to be struck by an inside pitch. The metacarpal bones for left hand 12 are shown in FIG. 3 as located in the general area 14. They are not protected by much muscle or other tissue, and are thus likely to break if struck by a pitched ball. That is, if ball 18 strikes the side or the back of the hand 12 in the area 14, impact on the metacarpal bones will likely result, and thereby cause one or more of those bones to break.

Figure 4:
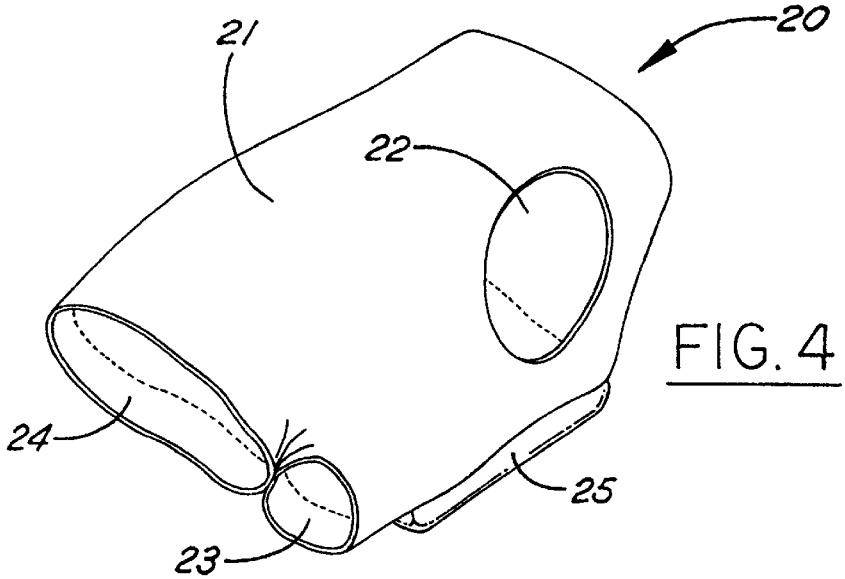
FIG. 4 is a perspective or isometric view of a hand protecting apparatus in accordance with the present invention.

An embodiment of a protective member 20 for left hand 12 in accordance with the present invention, intended to avoid, or at least significantly reduce the prospects of a metacarpal bone break, is shown in FIG. 4 in a perspective view looking generally towards the palm of hand 12 when worn. It is also shown as worn on hand 12 in FIGS. 5 and 6. Device 20 is configured here somewhat like a glove, but is actually intended to fit over or beneath a normal batting glove. The glove 20 is formed as a sleeve 21 and has a thumb hole 22, index finger hole 23 and an elongated slot or hole 24 for the remaining three fingers all positioned as shown to anchor the sleeve in a relatively fixed position over the hand.

If desired, the protective device 20 could take the form of a complete glove with full thumb and finger is sleeves, thereby avoiding use of an additional overlying or underlying glove. Furthermore, it is possible to employ separate holes far each finger or a single slot for all four fingers, if desired. However, the preferred configuration is as shown in FIG. 4, since this provides stability of location of the protective subassembly 25 with maximum comfort to the user.

Figure 5:
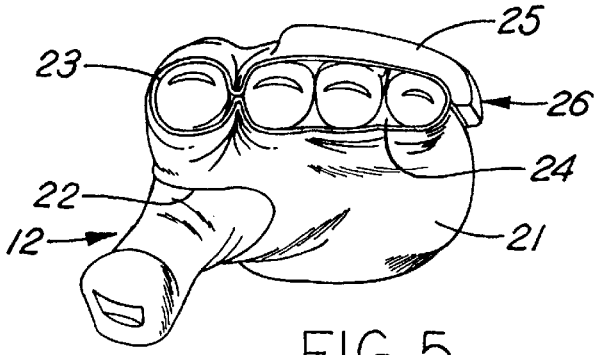
FIG. 5 a view looking towards the ends of the fingers of a person wearing a protective apparatus in accordance with the present invention.
Figure 6:
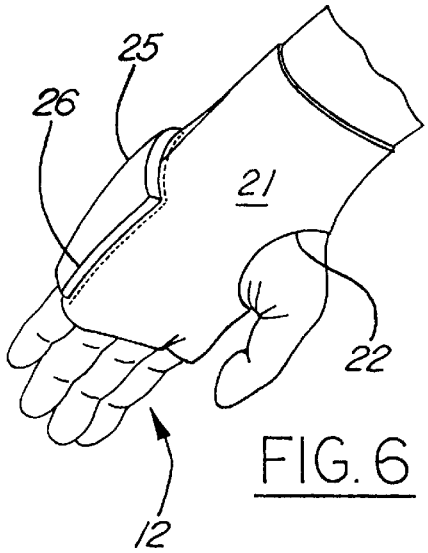
FIG. 6 is an isometric view from below the hand of a person wearing a glove in accordance with this invention particularly showing the protection of the metacarpal bone associated with the little finger of the wearer.

Protective device 20 is preferably made of highly stretchable Spandex type of material to facilitate putting the glove on and taking it off, as well as to minimize the feel of its presence when worn. The protective function for the hands is predominantly provided by subassembly 25 includes an impact absorbing element positioned to overly most of the metacarpal bone area of hand 12. As seen in FIGS. 5 and 6, subassembly 25 includes a portion 26 which extends around outer edge of hand 12 to protect it, even if hand 12 is hit by a ball while essentially in a horizontally flat orientation.

Figure 7:
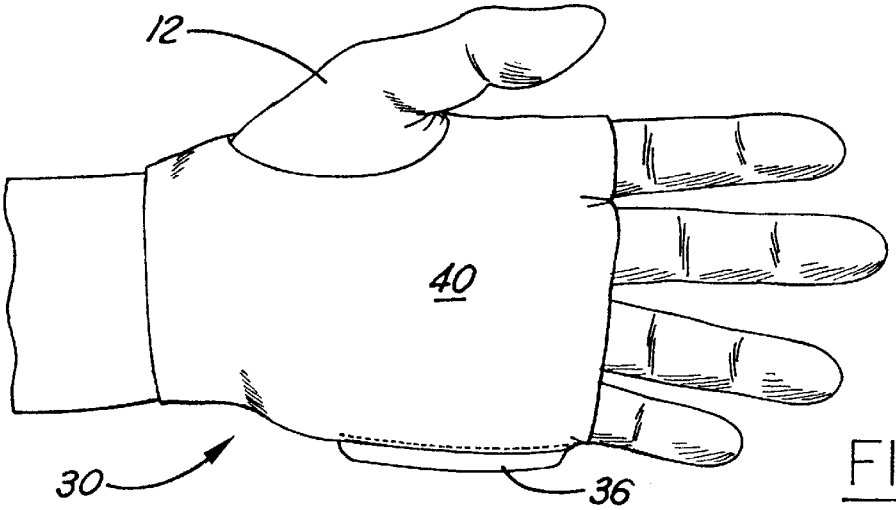
FIG. 7 is a view looking toward the palm of the hand of a user of a protective device in accordance with this invention.
Figure 8:
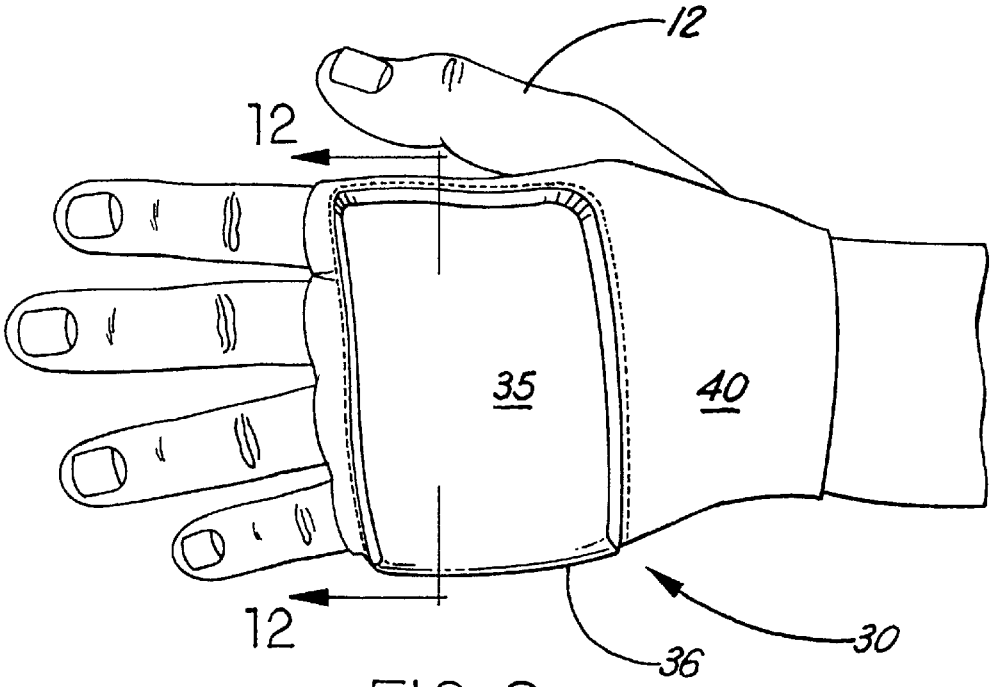
FIG. 8 is view looking towards the back of the hand of a person wearing an embodiment of a device in accordance with this invention.
Figure 12:
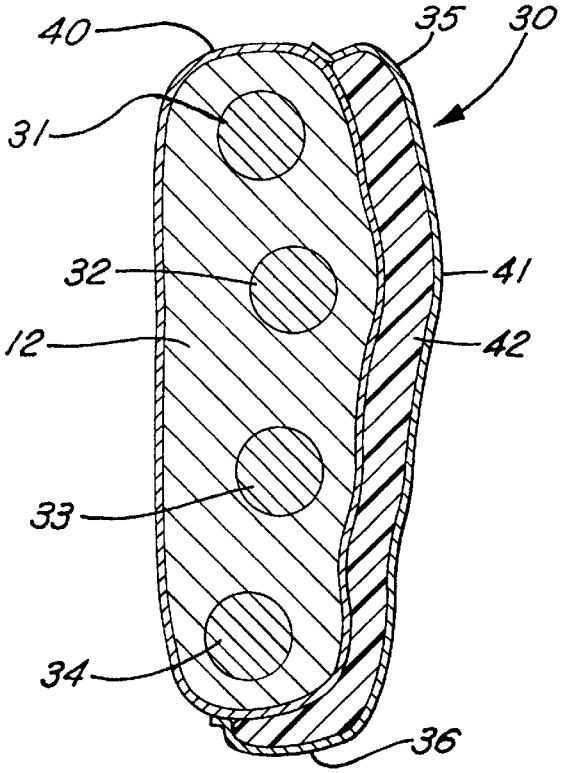
FIG. 12 is a section view taken along line 12—12 in FIG. 8.
Figure 13:
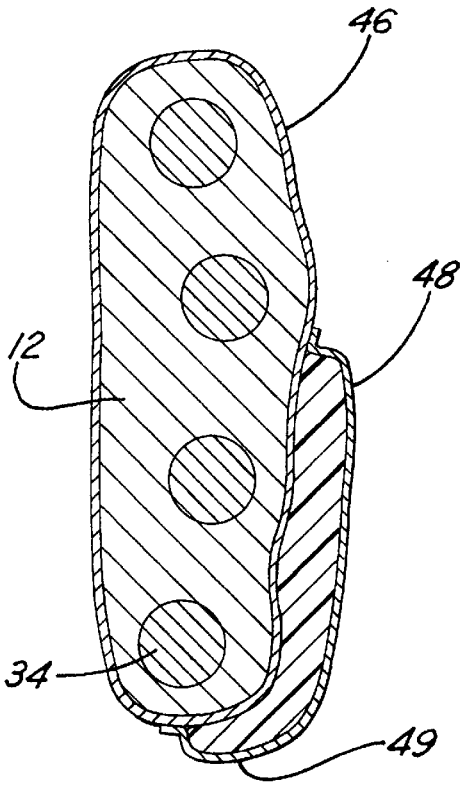
FIG. 13 is a section view taken along line 13—13 in FIG. 9.

Protective glove 30 for left hand 12 of batter 10 is presented in FIGS. 7, 8 and 12, and is another embodiment of the present invention. It includes a thumb hole, index finger hole and a three finger slot similar to that shown in FIG. 4. In this arrangement, protective subassembly 35 extends across the entire back of hand 12 so as to protect all the metacarpal bones 31–34 thereof. Note that end portion 36 extends around the outer edge of hand 12 to further protect bone 34, the smallest of the metacarpal bones.

Protective device 30 is constructed of a sleeve 40 of a stretchable material, such as Spandex, to permit slipping it into surrounding relation to hand 12. Another layer 42 likewise of a stretchable material is attached to sleeve 40 so as to form a pocket 42. Pocket 42 is filled with an impact absorbing material suitable for protecting hand 12 in general, and metacarpal bones 31–34, as well as the knuckles associated therewithin particular from injury.

In one device constructed in accordance with this invention, pocket 42 was filled with silicone gel sheet, which is a material normally employed for treatment and control of hypertrophic keloid scar tissue. It is semi-occlusive and easily cut by hand using scissors. It can withstand relatively high temperatures. While a single layer is shown as filling pocket 42 in FIG. 12 and such a single layer is preferable, two sheets each five millimeters thick were used in the aforementioned prototype for a total silicone gel layer thickness of ten millimeters.

The gel pads inserted in pocket 42 in the prototype did not exhibit any unacceptable tendency to migrate or bunch within that pocket. However, it is presently believed preferable to bond, glue or otherwise attach the impact absorbing pads to either the pocket forming layer 41 or the exterior of sleeve 40.

Figure 9:
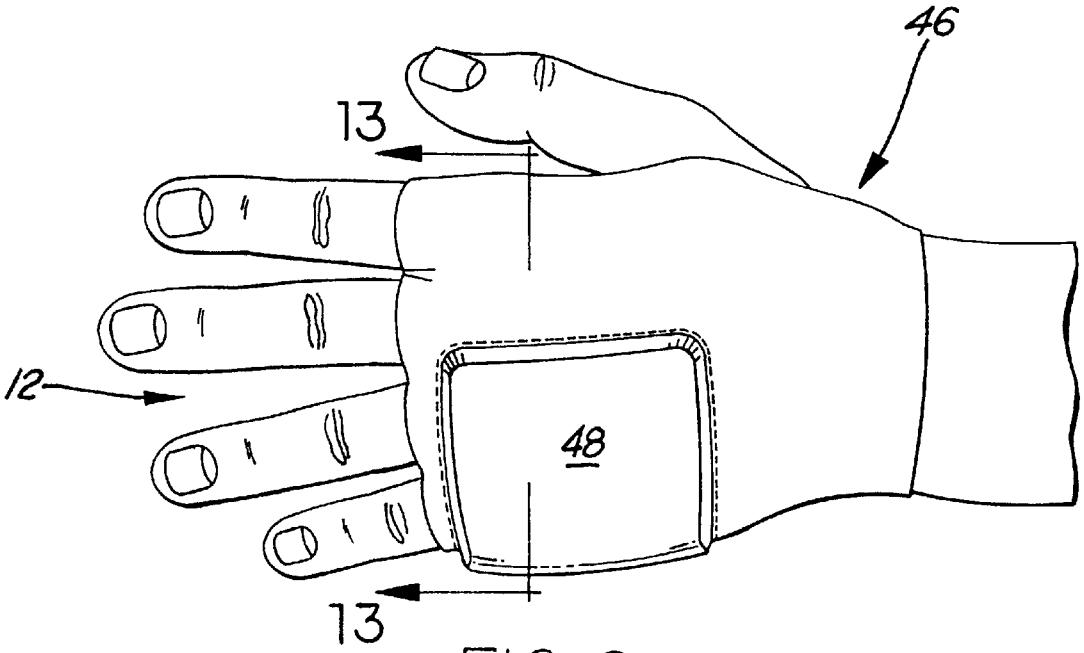
FIG. 9 is a top view of the hand of a user of one embodiment of this invention.
Figure 10:
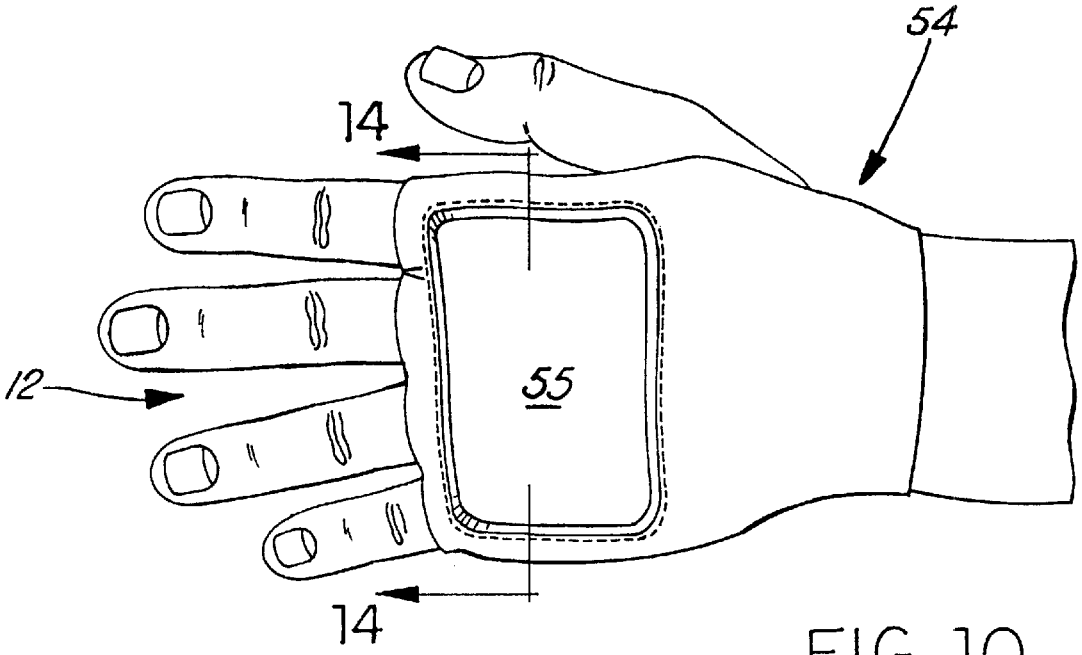
FIG. 10 is a top view of the hand of a user of yet another embodiment of the present invention.
Figure 11:
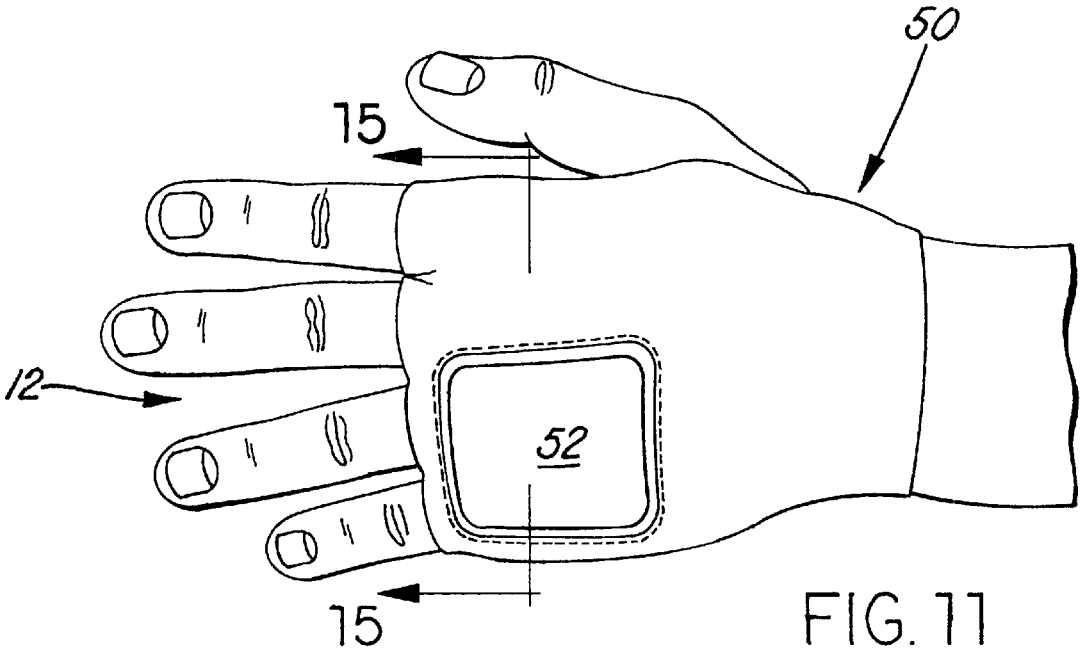
FIG. 11 is another top view of the hand of a user of yet another embodiment of this invention.
Figure 14:
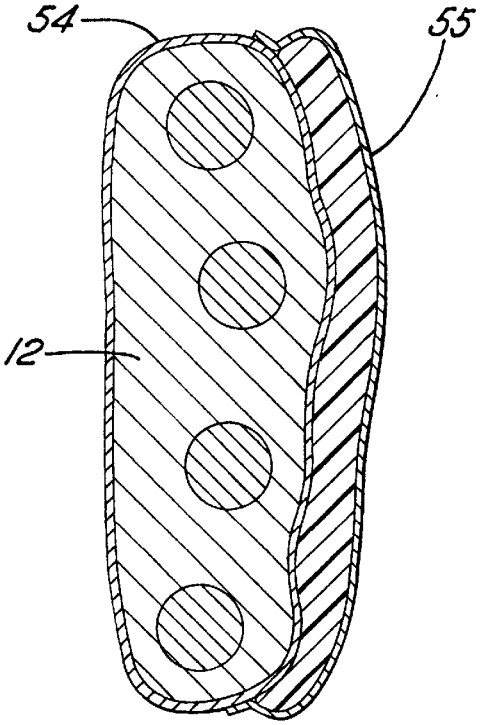
FIG. 14 is a section view taken along line 14—14 in FIG. 10.
Figure 15:
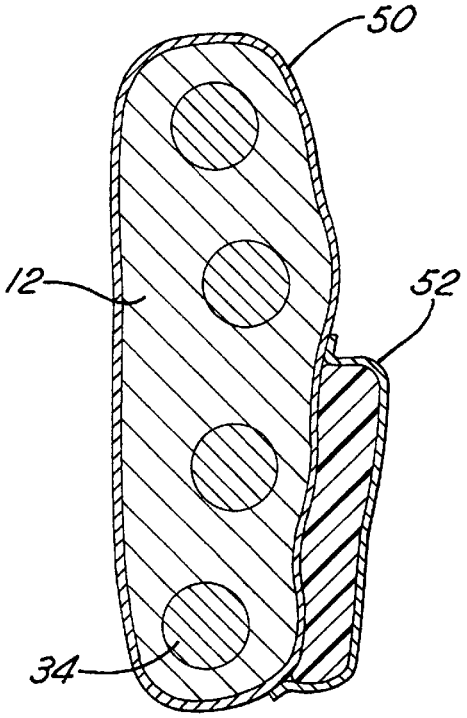
FIG. 15 is a section view taken along line 15—15 in FIG. 11.

Medical grade silicone gel sheet material is resistive to compression set in that it is flexible, but will always return to its original shape. It is thermally tolerant, as mentioned, and has long term biocompatibility while exhibiting high tensile strength without supporting bacterial growth. It is attractive for use in conjunction with the present invention because it has excellent shock and vibration absorbing and disbursement qualities. It likewise has gas permeable qualities and will not warm beyond the body temperature FIGS. 2 and 3 suggest that the greatest risk of injury is to the metacarpal bones 34 and 33 of the little finger and ring finger respectively. Thus, some players may prefer the smaller padding of FIGS. 9 and 13 and FIGS. 11 and 15. The primary difference between the FIGS. 9/13 and FIGS. 11/15 embodiments is the inclusion in the former of an extension 49 surrounding the edge of hand 12 along with bone 34. The FIGS. 10 and 14 embodiment likewise is similar to the glove 30 of FIGS. 7 and 8, except it does not include the edge protecting extension 36 of the latter.

Figure 16:
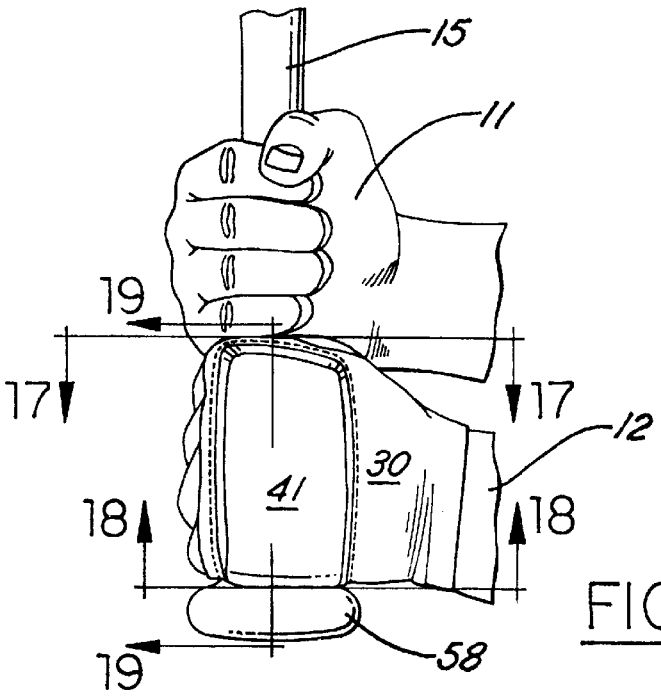
FIG. 16 is a view of the orientation of the hands of a user of this invention as they grip the handle of a baseball bat.
Figure 17:
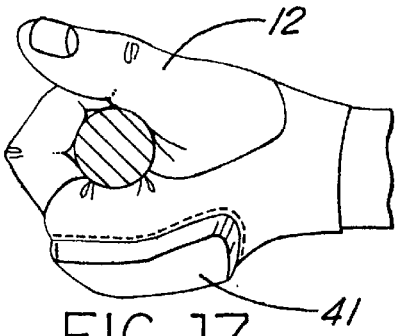
FIG. 17 is a section view taken along line 17—17 of FIG. 16 and looking downward on the protected hand.
Figure 18:
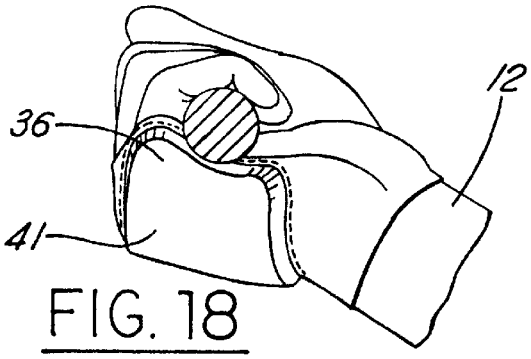
FIG. 18 is a section view from the knob end of a baseball bat taken along line 18—18 of FIG. 16 and showing the protected hard of the user.
Figure 19:
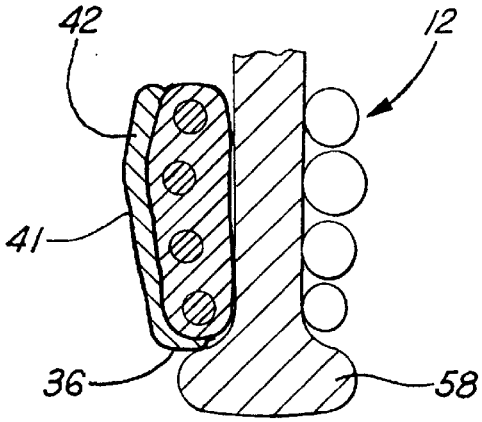
FIG. 19 is a section view taken along line 19—19 in FIG. 16 illustrating the protective effect relative to the metacarpal bores of the user.
Figure 20:
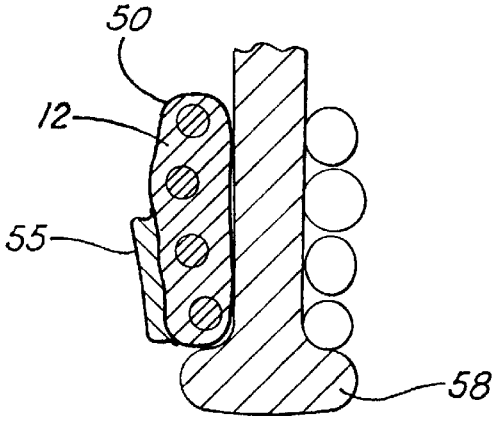
FIG. 20 is a section view of a hand protecting device along the lines of FIGS. 11 and 15.

FIG. 16 shows the location of a protective glove 30 as the user grips bat 15. Typically, such bats include a knob 58 on the end nearest the grip by batter 10. The overlapping portion 36 is seen as filling the space between the little finger of left hand 12 and knob 58. Since the knob 58 provides a slight protective ridge for the little finger, some batters may prefer not to include the overlap portion. Thus, those batters might prefer an embodiment along the lines of FIGS. 10 and 14 or FIGS. 11 and 15. The FIGS. 11 and 15 type embodiment is shown in section view in FIG. 20. This configuration permits the batter to abut their hands against knob 58 essentially as they did without protective glove 50 or 54.

Figure 21:
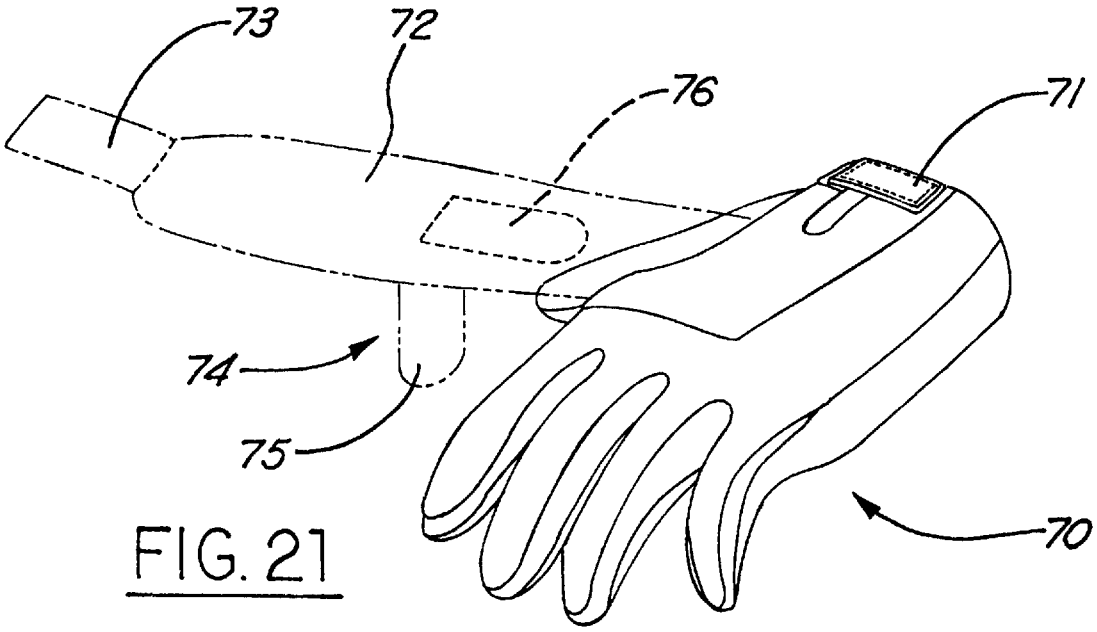
FIG. 21 is an isometric view of a typical batting glove with a size adjusting strap.

A generally conventional glove 70 worn by some baseball players is shown in FIG. 21. It typically includes a snap or Velcro retainer 71 at the wrist and a stretchable strap 72 which has a Velcro strip 73 on its extremity and a mating Velcro grip 74. Grip 74 is configured with the same type of Velcro material on their inwardly facing surfaces to attach to both sides of strip 73 when it is in place.

This structure permits the player to adjust the tension which is applied to the periphery of glove 70 as it is worn. Strap 72 can provide securing of a protective pad in place either in a pocket or by other retention means such as another Velcro strip in structure somewhat along the lines of that discussed hereinbelow.

Figure 22:
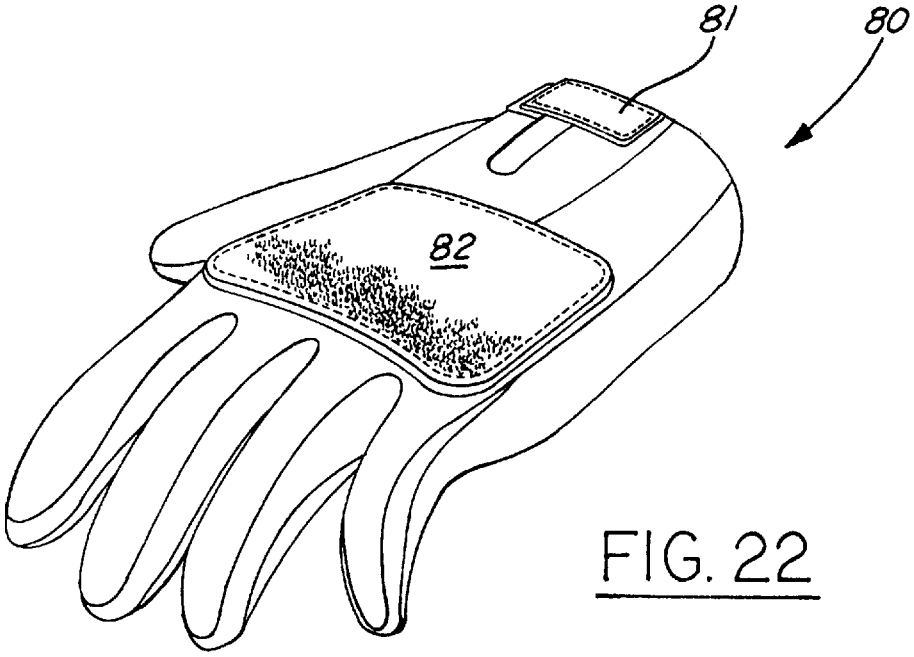
FIG. 22 is a batting glove with a pad for securing a protecting pad to its outer surface.

Another glove 80 is shown in FIG. 22 which is likewise secured at the wrist by a retainer 81. However, glove 80 has a Velcro pad 82 bonded or sewn to its outer surface across the back of the hand. This is to cooperate with the two piece subassembly of FIG. 23 formed of shell 84 and pad 86 preferably of the same protective gel, or the like, as was described earlier. A contemporary product called Silopose is believed satisfactory for the gel pad constituent.

Element 85 is formed of a somewhat flexible but relatively hard material, such as hard plastic or rubber. It is preferably fabricated from thermal moldable rubber or plastic based materials which become generally rigid when cooled. Contemporary products suitable for this purpose include products sold under the names of Orthoplast, Nickelplast and Aquaplast, for example.

Figure 24:
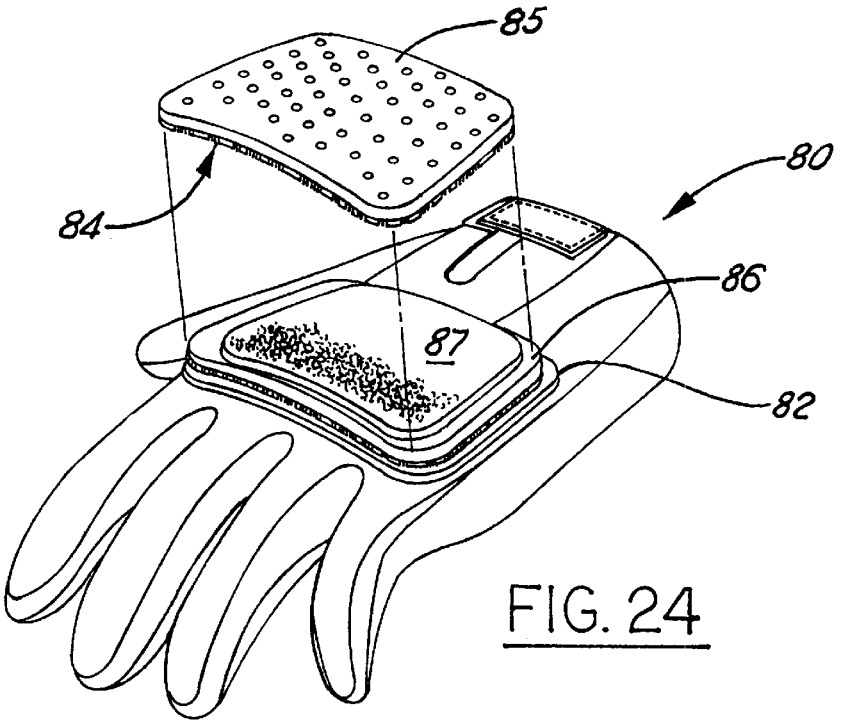
FIG. 24 shows the FIGS. 22 and 23 elements in relation to each other.

The three-stage layering of the subassembly is presented in FIG. 24 with regard to glove 80. The lower Velcro surface 88 of gel pad 86 is attached to the Velcro pad 82 on glove 80. The overlying relation of shell 85 to gel pad 86 and its securement via mating of Velcro surfaces 84 and 87 is readily apparent in FIG. 24.

The female type of Velcro material is softer and less abrasive than the matching male material. Thus, by using the female type for surface 82, it is possible to wear glove 80 without any significant discomfort to the user without adding either, or both, of the protective elements 85 and 86. Note it is possible to wear glove 80 with either protective shell 85 or gel pad 86 in place on surface 82, exclusive of the other. Note further that the protective pad and its mating receiver surface can extend around the lateral edge of the hand in a manner similar to that discussed previously herein.

Figure 25:
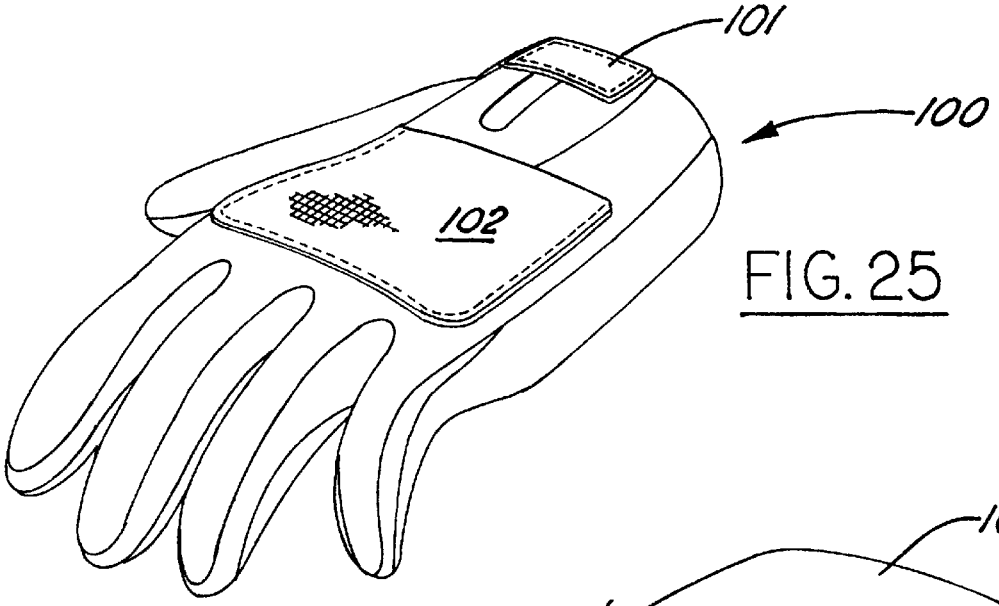
FIG. 25 is a view of another glove with a pocket for receiving protective elements.
Figure 26:
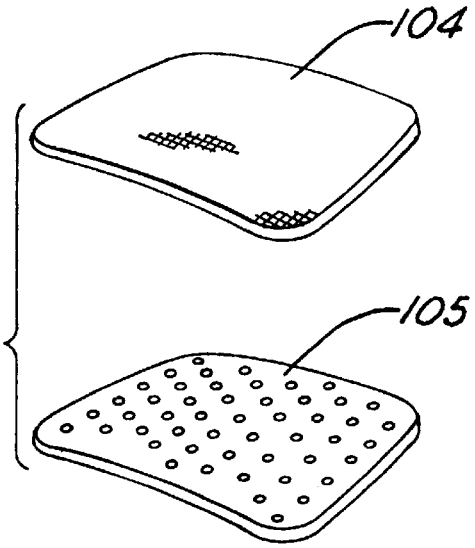
FIG. 26 is a view of the protective elements useful for insertion into the pocket of the FIG. 25 glove.

FIG. 25 presents a glove 100 securable at the wrist by catch 101. For glove 100, the protective elements are selectively usable in conjunction with a pocket 102 and are illustrated in FIG. 26. These include shell 104 preferably of material similar to element 85 and a gel pad 105 similar to element 86. However, elements 104 and 105 do not have Velcro surfaces bonded thereto since pocket 102 is of stretchable material to allow insertion of either, or both, of elements 104 and 105 therein.

Figure 28:
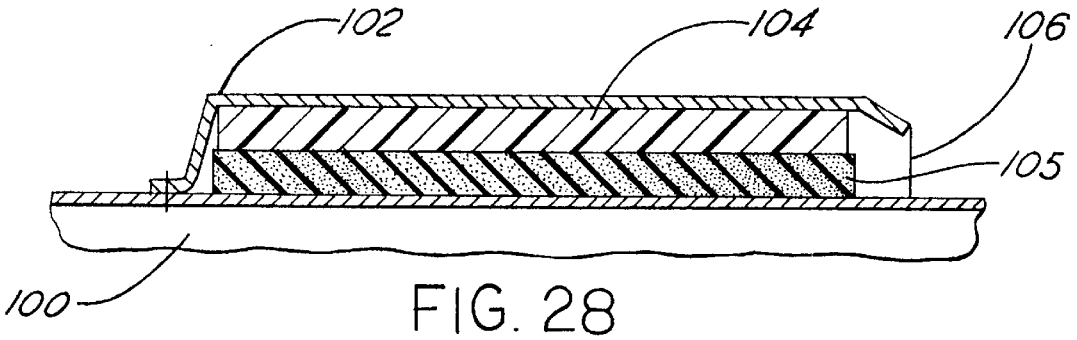
FIG. 28 is a broken section view taken along line 28—28 in FIG. 27.
Figure 27:
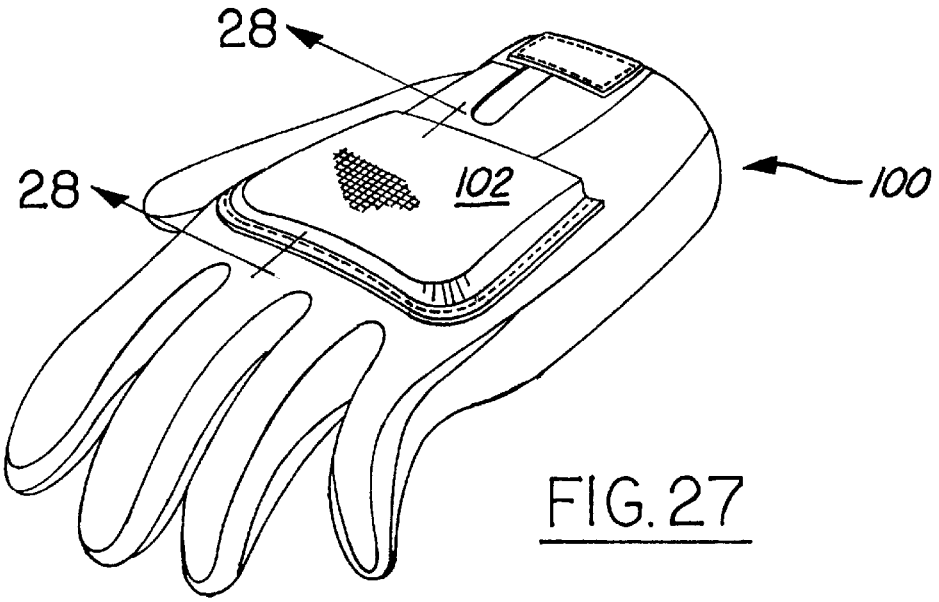
FIG. 27 is a view of the FIG. 25 glove with protective elements of FIG. 26 inserted in the pocket.

The foregoing is presented in FIG. 27 and the fragmented section view of FIG. 28 taken along section line 28—28 of FIG. 27. Mouth 106 of pocket 102 is stretched to allow insertion of both elements 104 and 105 as shown after which the resilience of the material for pocket 102 holds those elements in place. As mentioned previously, a similar result is possible by employing a stretch strap along the lines of strap 72 in FIG. 21.

Some baseball players may prefer to wear the current type of glove under the protective device since they have become acclimated to the feel of such gloves on the bat. While it is possible to wear a contemporary glove under a protective device, such as that shown earlier in conjunction with FIGS. 4–11, those devices add an extra layer between the palm of the user and the bat surface. Simply cutting out the material in the palm of a glove similar to FIGS. 4–11 might satisfy the user. However, yet another arrangement for providing the wearer with the normal glove to bat feel is shown in FIGS. 29–34.

Figure 29:
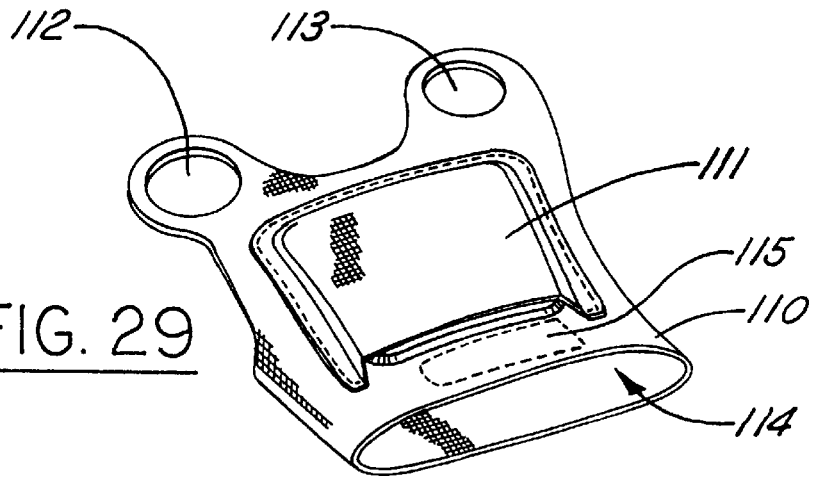
FIG. 29 is a view of a stretchable glove with a protective element receiving pocket for use on top of another glove.
Figure 30:
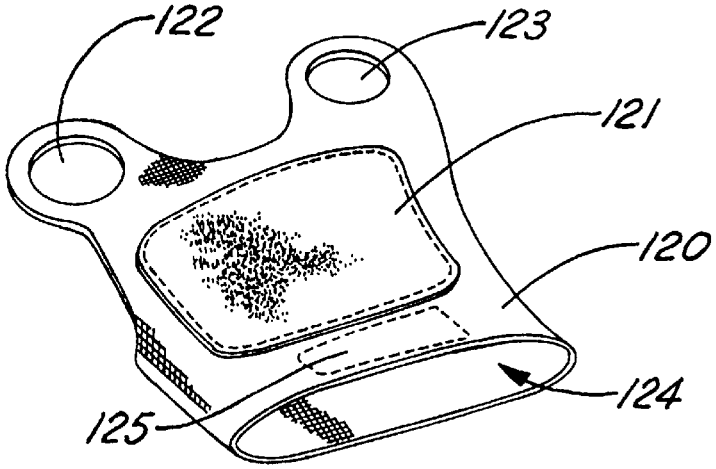
FIG. 30 is a glove somewhat similar to FIG. 29 except including a Velcro receiving pad for retaining the protective element in place.

Protective devices 110 and 120 of FIGS. 29 and 30, respectively, are similar in that they are both made of stretchable material to allow putting them on over an existing glove. They also each have finger holes such as 112/113 and 122/123 to slip over the fingers of the wearer to help hold the device in place. Note that it is possible to include additional finger holes and/or thumb holes in either of these devices if desired. The gloves 110 and 120 are retained against movement by a Velcro strip 115 and 125 to mate with similar strips on the glove.

Figure 31:
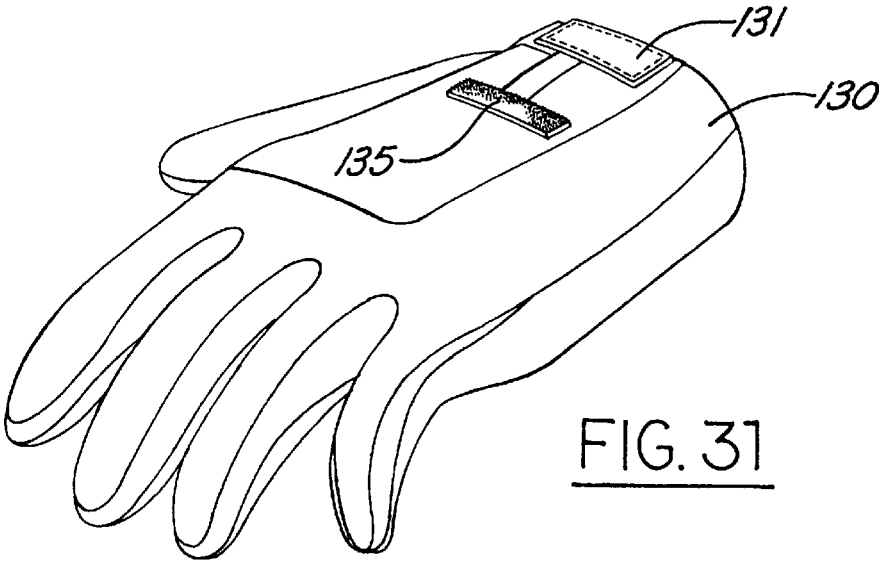
FIG. 31 is a view of a glove adapted to cooperate with the overlying gloves constructed along the lines of FIGS. 29 and 30.

These devices differ in that glove 110 has a pocket 111 for receiving a protective shell or gel pad whereas those devices are attachable to glove 120 via the Velcro type material. A typical contemporary glove 130 is shown in FIG. 31 modified to cooperate with a protective device similar to the FIGS. 29 and 30 structures. It has a Velcro retainer pad 131 at the wrist and a Velcro patch 135 on its outer, back surface to secure devices 110 or 120 via interfacing with mating patches 115 or 125. Either the entire hand is passed through opening 124 when the glove is put on or all of the hand except the thumb is introduced through opening 124.

Figure 32:
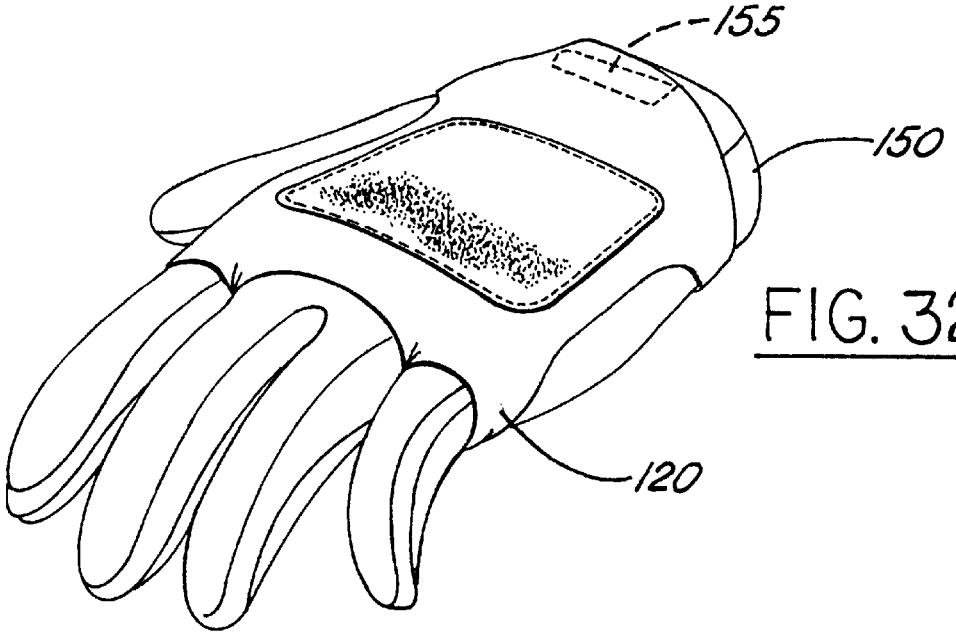
FIG. 32 shows a glove somewhat similar to that of FIG. 31 with the FIG. 30 overlying glove in place.

A similar arrangement but with a slightly different location for the retainer strip is depicted in FIG. 32. In this configuration, an overlying sleeve along the lines of glove 120 is shown in place over glove 150 but with no protective pad or shell attached to Velcro surface 121. Glove 150 is conventional with a securing Velcro strip 155 at the wrist except that strip 150 also has Velcro material (preferably of the female type) on its outer surface to cooperate with the retainer strip 125 of glove 120.

The FIG. 32 configuration allows passing the entire hard through the sleeve opening 124 including the thumb. While the FIGS. 32 and 34 illustrations assume the thumb is introduced to the same open areas the rest of the fingers of the hand, it is readily apparent a separate thumb hole could be included in sleeve 120.

Figure 23:
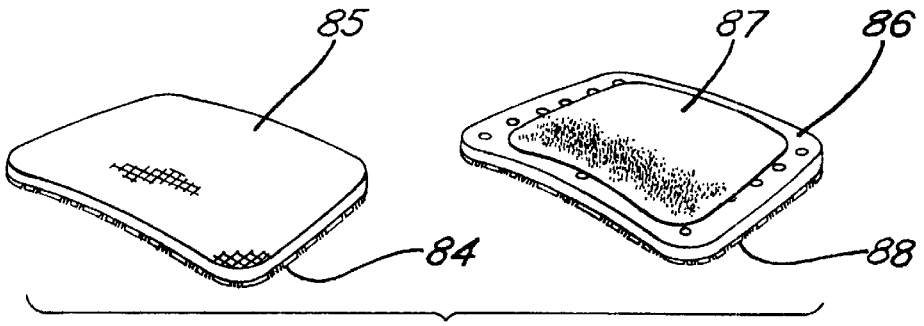
FIG. 23 is a disassembled view of a two element protective pad.
Figure 33:
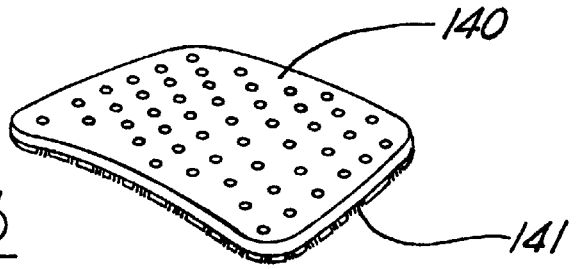
FIG. 33 shows the relationship of a protective pad with respect to the FIG. 32 glove.

FIG. 33 shows a typical protective device 140 suitable for cooperating with gloves like 130 or 150. It has a Velcro surface 141 to attach to surface 121. Device 140 can be of the shock absorbing gel, the hard plastic or rubber shell, or even a bonded combination thereof, although a three-stage device along the lines of FIG. 23 is acceptable. It can also be bonded to the sleeve 110 or 120 with the shell, gel pad or both, likewise bonded to one another and to the sleeve 110 or sleeve 120.

Figure 34:
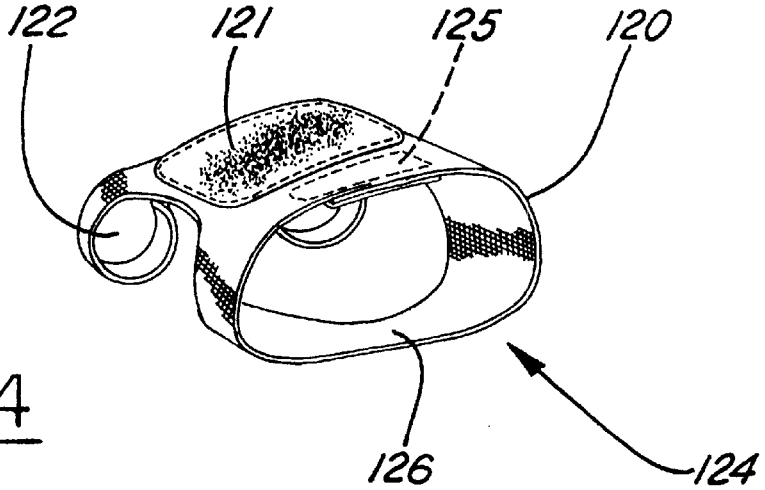
FIG. 34 is an isometric view of the overlying glove in accordance with FIG. 30 when in place on a FIG. 31 glove or as shown in FIG. 32.

FIG. 34 presents glove 120 as it would appear after application over a conventional glove or a glove similar to 130 or 150. It is fabricated of stretchable material so that the mouth 124 (or 114 in FIG. 29) can slip over the fingers of the user to allow insertion of the fingers in the finger holes like 122.

If desired, the slip-over type sleeve 120 can be made of flexible material that is not significantly stretchable such as the material used in contemporary baseball gloves. In that case, it might prove preferable to include a retainer of some type such as a snap, Velcro mating surfaces similar to that shown in FIG. 31, or the like. Thus the wrist engaging area 126 could be cut and a retainer located there to facilitate putting sleeve 120 on and off over the glove.

While the exemplary preferred embodiments of the present invention are described herein with particularity, those having normal skill in the art will recognize various changes, modifications, additions and applications other than those specifically mentioned herein without departing from the spirit of this invention. For example, the present invention is predominantly useful for baseball players, and thus is described herein with emphasis on that environment. However, the invention is not so limited in its application and/or utility.

What is claimed is:

1. A baseball glove consisting essentially of a flexible fabric glove having a main glove body, said main glove body defining a hand-receiving cavity and having a front glove surface and a back glove surface, said main glove body having four finger-receiving projections and one thumb-receiving projection, a back surface of said four finger-receiving projections forming part of said back glove surface and a front surface of said four finger-receiving projections forming part of said front glove surface, said main glove body further having a palm surface and a backhand surface, said palm surface forming part of said front glove surface and said backhand surface forming part of said back glove surface, said palm surface and said backhand surface being in opposed relationship to one another, said backhand surface having attachment means attached thereto, said palm surface and said backhand surface forming a central glove portion, said central glove portion being disposed proximal of said four finger-receiving projections, an intersection of said central glove portion with said four finger-receiving projections being defined along a region perpendicular to an axis extending from a wrist portion of said main glove body to said four finger-receiving projections, said wrist portion being disposed proximal of said central glove portion and having a wrist edge that defines an opening which is adapted to provide access to said hand-receiving cavity, a sleeve having an inner surface and an outer surface, a single protective plate attached to said outer surface of said sleeve and attachment means connected to said inner surface of said sleeve, said sleeve having a thumbhole opening and at least one finger opening, said thumb receiving projection extending through said thumbhole opening and at least one of said finger-receiving projections extending through said finger opening, wherein said attachment means on said backhand surface is detachably attached to said attachment means on said inner surface of said sleeve, said single protective plate having a front edge and a back edge, said front edge of said single protective plate being spaced from said intersection of said central glove portion with said four finger-receiving projections, said back edge being spaced from said wrist edge, wherein said protective plate is a rigid plastic material.

* * * * *